US006543758B2

(12) United States Patent
Imura et al.

(10) Patent No.: US 6,543,758 B2
(45) Date of Patent: Apr. 8, 2003

(54) IMAGE FORMING APPARATUS

(75) Inventors: Tomoaki Imura, Sunto-gun (JP); Katsuhiko Oba, Odawara (JP); Eiji Wakiyama, Sunto-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 159 days.

(21) Appl. No.: 09/781,392

(22) Filed: Feb. 13, 2001

(65) Prior Publication Data

US 2001/0028144 A1 Oct. 11, 2001

(30) Foreign Application Priority Data

Feb. 15, 2000 (JP) ..... 2000-037166
May 31, 2000 (JP) ..... 2000-162970

(51) Int. Cl.[7] ..... B65H 5/00
(52) U.S. Cl. ..... 271/9.12
(58) Field of Search ..... 399/369, 393; 271/9.11, 9.12, 9.13, 127

(56) References Cited

U.S. PATENT DOCUMENTS 4,877,230 A * 10/1989 Winkler et al. ..... 271/3.15
5,213,427 A * 5/1993 Grosse et al. ..... 346/104
6,446,832 B1 * 9/2002 Holec et al. ..... 221/7

OTHER PUBLICATIONS

Littman, Dan, "The Paper Chase", Jun. 2000, PCWorld, vol. : 18, Issue: 6, pp. 56–60.*

* cited by examiner

*Primary Examiner*—Donald P. Walsh
*Assistant Examiner*—Kenneth W Bower
(74) *Attorney, Agent, or Firm*—Fitzpatrick, Cella, Harper & Scinto

(57) ABSTRACT

An object of the present invention is to provide an image forming apparatus in which various kinds of sheets can be used and which can be made compact and reduce the number of parts. The present invention provides an image forming apparatus for forming an image on a sheet, which has a sheet feeding cassette, first sheet feeding means, and image forming means, wherein the sheet feeding cassette is provided with second sheet feeding means for feeding out a sheet contained in a second sheet storing portion different from the first sheet storing portion of the sheet feeding cassette.

17 Claims, 13 Drawing Sheets

MULTI SHEETS SUPPLYING MOVEMENT SEQUENCE

FIG. 10

| | DRIVING SOURCE (STEPPING MOTOR) | DRIVING ROTARY LEVER | PICKUP ROLLER FOR SUPPLYING MULTI SHEETS |
|---|---|---|---|
| (1) | START STOPPING OF NORMAL ROTATION | INITIAL POSITION | STOP |
| (2) | FINISH STOPPING | INITIAL POSITION | STOP |
| (3) | STOPPING AND START REVERSE ROTATION | INITIAL POSITION | STOP |
| (4) | ACCELERATING REVERSE ROTATION | START ROTATING TO PUSHING POSITION | STOP |
| (5) | FINISH ACCELERATING AND ROTATING REVERSELY | ROTATING TO PUSHING POSITION | STOP |
| (6) | START STOPPING OF REVERSE ROTATION | ROTATING TO PUSHING POSITION | STOP |
| (7) | FINISH STOPPING | PUSHING POSITION | STOP |
| (8) | STOPPING AND START NORMAL ROTATION | PUSHING POSITION | STOP |
| (9) | ACCELERATING NORMAL ROTATION | START ROTATING TO INITIAL POSITION | START PICKING UP |
| (10) | FINISH ACCELERATING AND ROTATING NORMALLY | ROTATING TO INITIAL POSITION | PICKING UP |
| (11) | ROTATING NORMALLY | INITIAL POSITION | PICKING UP |
| (12) | ROTATING NORMALLY | INITIAL POSITION | STOP |

IMAGE FORMING APPARATUS

BACKGROUND OF THE INVENTION

1. Field of the Invention

The present invention relates to an image forming apparatus such as a copying machine, a printer and the like, and more particularly, it relates to an apparatus for supplying a sheet to image forming means.

2. Related Background Art

In some conventional image processing apparatuses such as copying machines, printers and the like, sheets on which images are to be formed are contained in a sheet feeding cassette which can be drawn from a main body of the apparatus, and the sheets are picked up one by one by means of a sheet feeding mechanism provided in the main body of the apparatus, and the picked-up sheet is supplied to image forming means.

By the way, in case of an image forming apparatus in which various kinds of sheets are required to be used, there may be provided a multi sheet feeding apparatus in which, independently from the sheet feeding cassette, various kinds of sheets can be set by manual insertion and which includes a sheet storing portion for stacking and containing sheets to be set, and sheet feeding means such as a pick-up roller for feeding out the sheet stacked and contained in the sheet storing portion to image forming means.

However, in a conventional image forming apparatus having such a multi sheet feeding apparatus, the multi sheet feeding apparatus may prevent compactness of the image forming apparatus itself since it (including the sheet feeding means) assumes a large space within the image forming apparatus. Further, the number of parts is increased.

Incidentally, in order to make the multi sheet feeding apparatus more compact, for example, so-called manual sheet feed may be effected by providing a guide member on a part of the sheet feeding cassette in place of the sheet feeding means and by feeding-the sheet set on the guide member one by one. However, with this arrangement, the sheets cannot be fed continuously, and, thus, this arrangement is unsuitable for use with an image forming apparatus installed under a net-worked environment.

SUMMARY OF THE INVENTION

The present invention is made in consideration of the above circumstances, and an object of the present invention is to provide an image forming apparatus in which various kinds of sheets can be used and which can be made compact and reduce the number of parts.

The present invention provides an image forming apparatus for forming an image on a sheet, comprising a sheet feeding cassette containing sheets and mounted to a main body of the apparatus for a drawing movement, first sheet feeding means for feeding out the sheet from a first sheet storing portion provided in the sheet feeding cassette, and image forming means for forming an image on the sheet fed out by the first sheet feeding means, wherein the sheet feeding cassette is provided with second sheet feeding means for feeding out a sheet contained in a second sheet storing portion different from the first sheet storing portion of the sheet feeding cassette.

BRIEF DESCRIPTION OF THE DRAWINGS

FIG. 10 is a table showing a sequence when the sheets are supplied from the multi supplying means;

DESCRIPTION OF THE PREFERRED EMBODIMENTS

The present invention will now be fully explained in connection with embodiments thereof with reference to the accompanying drawings.

First of all, a color printer (image forming apparatus) 9 having sheet supplying means 8 will be explained with reference to FIG. 1. Incidentally the present invention can be applied to not only the color printer but also an image forming apparatus such as a copying machine, a facsimile apparatus and combination thereof.

Figure 1:
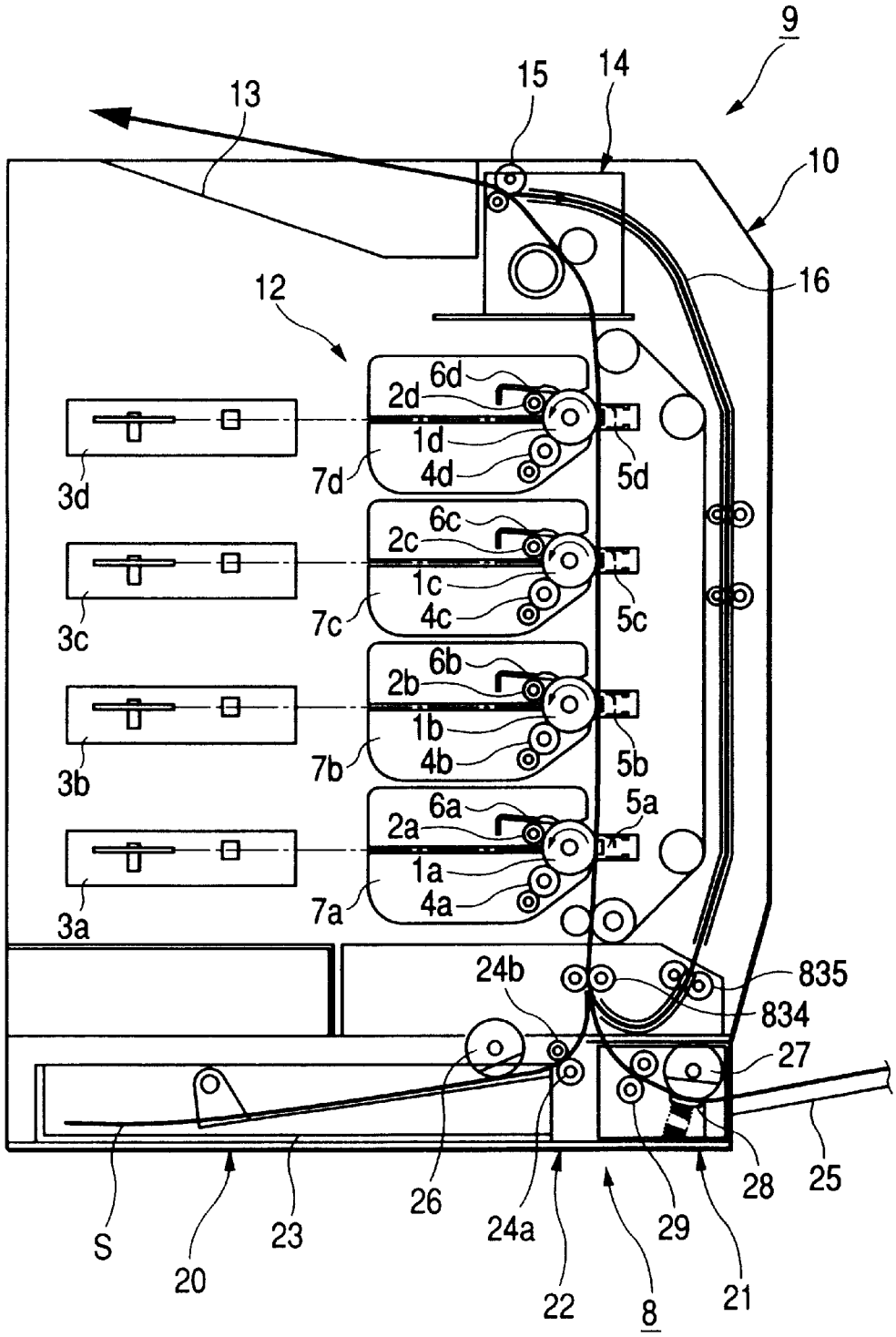
FIG. 1 is a schematic constructural view of a printer as an example of an image forming apparatus according to an embodiment of the present invention.

In FIG. 1, the color printer 9 comprises a main body 10 of the apparatus including the sheet supplying means 8 and image forming means 12 for effecting image process on a sheet fed out from the sheet supplying means 8. The sheet supplying means 8 includes sheet feeding cassette supplying means 20 capable of feeding-in a sheet from a sheet feeding cassette containing sheets, and multi supplying means 21 capable of feeding-in a sheet manually set by an operator, so that the sheet is supplied to the image forming means 12 selectively from the sheet feeding cassette supplying means 20 or the multi supplying means 21.

The image forming means 12 includes four photosensitive drums 1*a*, 1*b*, 1*c*, 1*d* corresponding to four colors as magenta, cyan, yellow and black, charging means 2*a*, 2*b*, 2*c*, 2*d* for uniformly charging surfaces of the respective photosensitive drums, exposing means 3*a*, 3*b*, 3*c*, 3*d* for forming electrostatic latent images on the respective photosensitive drums by illuminating laser beams in response to respective image informations, developing means 4*a*, 4*b*, 4*c*, 4*d* for visualizing the electrostatic latent images as toner images by adhering toners to the electrostatic latent images, transfer rollers 5*a*, 5*b*, 5*c*, 5*d* as transfer means for transferring the toner images on the photosensitive drums onto the sheet, and cleaning means 6*a*, 6*b*, 6*c*, 6*d* for removing toners remaining on the respective photosensitive drums after the transferring. The charging means and the developing means are disposed in order in a rotational direction around the corresponding photosensitive drum.

The photosensitive drums 1*a*, 1*b*, 1*c*, 1*d*, charging means 2*a*, 2*b*, 2*c*, 2*d*, developing means 4*a*, 4*b*, 4*c*, 4*d* and cleaning means 6*a*, 6*b*, 6*c*, 6*d* are integrally incorporated into cartridge units to form process cartridges 7*a*, 7*b*, 7*c*, 7*d*, respectively.

The sheet supplied from the sheet supplying means 8 is conveyed from an upstream side (downward direction in FIG. 1) toward a downstream side (upward direction in FIG. 1) in a sheet conveying direction. Meanwhile, a magenta color toner image, a cyan color toner image, an yellow color toner image and a black color toner images are successively transferred onto the sheet in a superimposed fashion, thereby forming a color image. Thereafter, the image is fixed to the sheet by a fixing unit 14, and, thereafter, the sheet is discharged onto a discharge tray 13.

Further, when images are formed on both surfaces of a sheet, the sheet having one surface on which the image was formed is turned over (surface-reversed) by a pair of discharge rollers 15 to direct the sheet into a reverse path 16, and an image is formed on a second surface of the sheet by the image forming means 12. Thereafter, the sheet is discharged onto the discharge tray 13.

Figure 2:
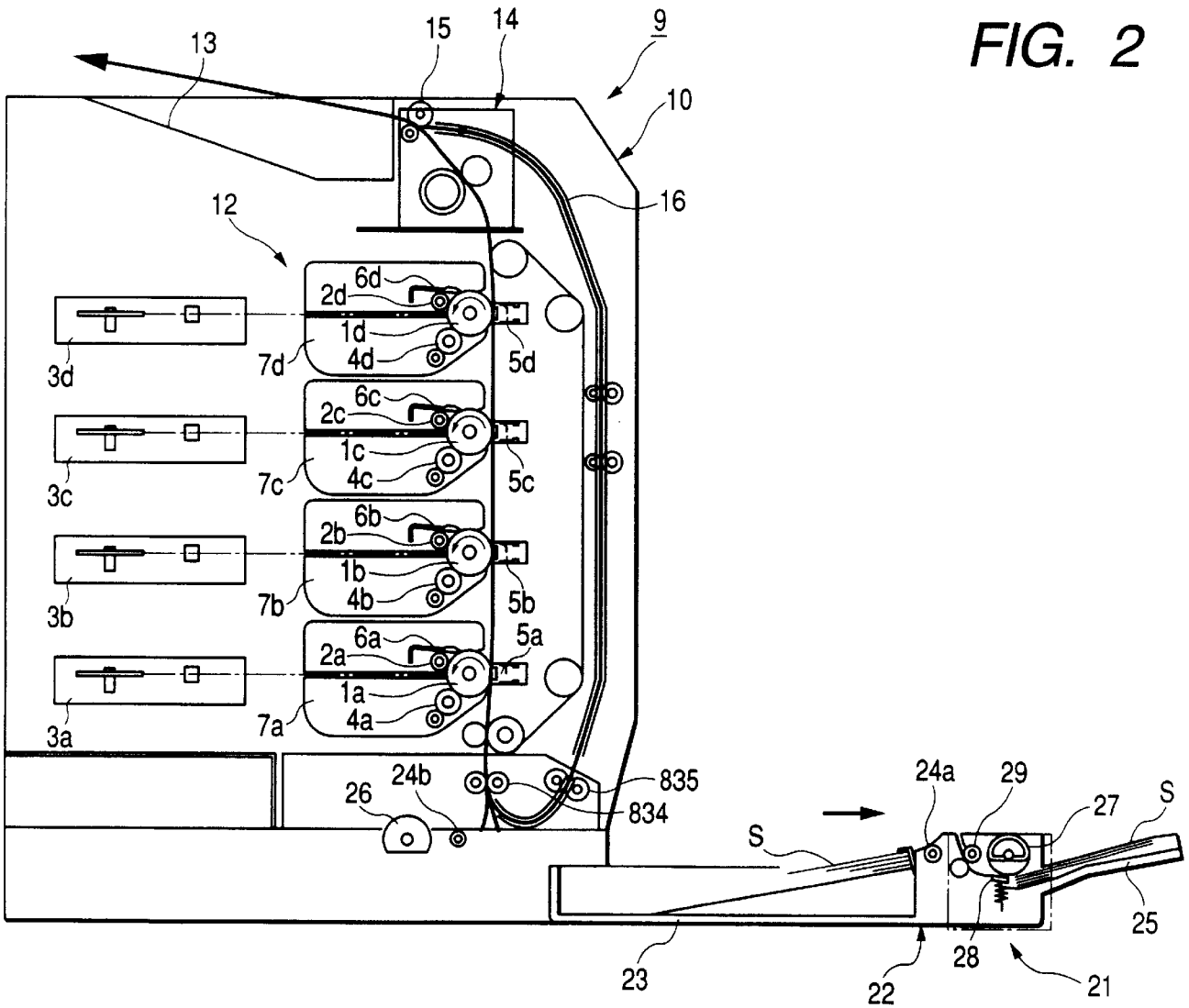
FIG. 2 is a view showing a condition that a sheet feeding cassette of the printer of FIG. 1 is drawn.
Figure 3:
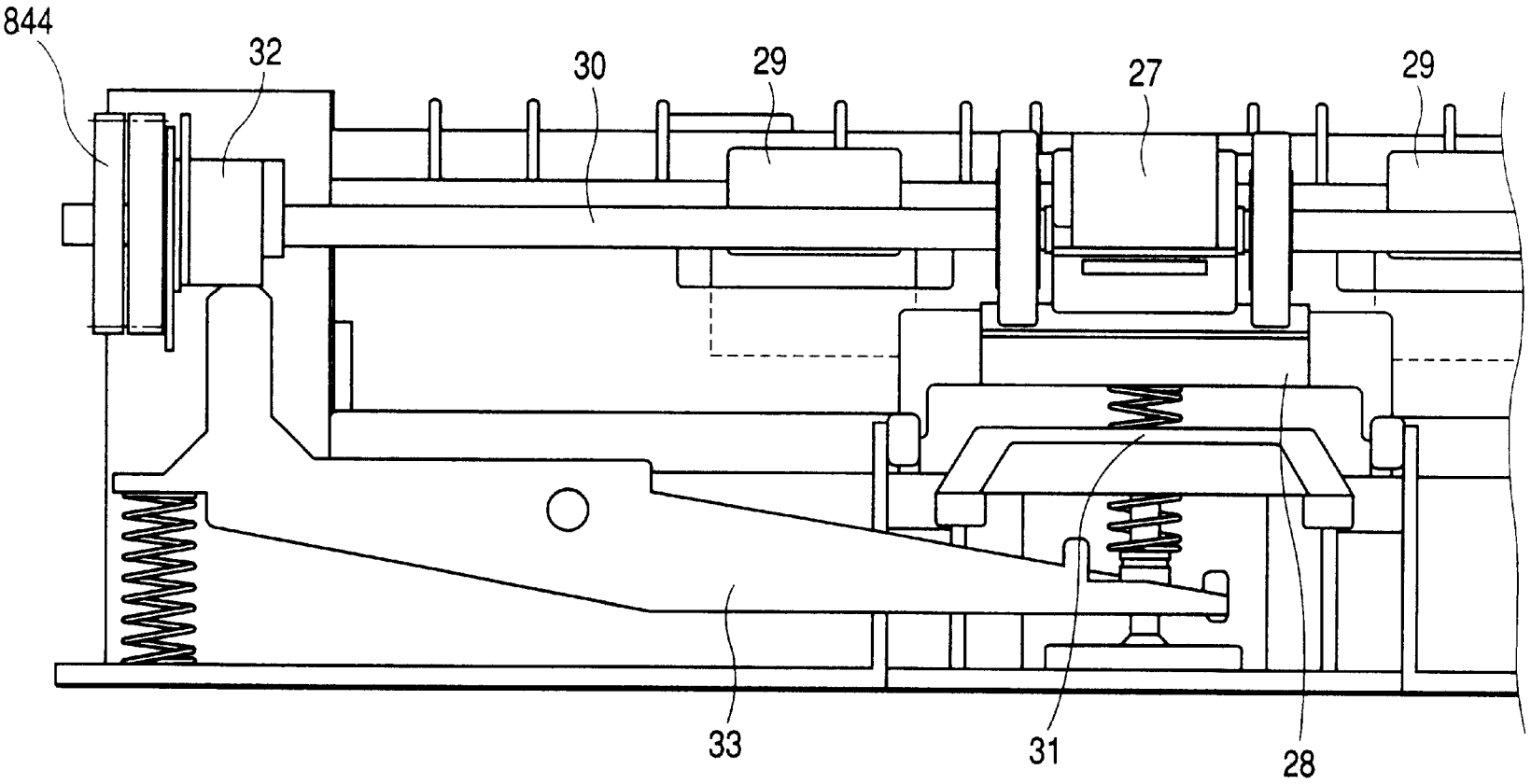
FIG. 3 is a front view of multi sheet supplying means provided on the sheet feeding cassette of FIG. 1.

Next, the sheet supplying means 8 will be described with reference to FIGS. 2 and 3. Incidentally, FIG. 3 is a view of the multi supplying means 21, looked at from a side of the stacked sheets to be supplied.

There is provided a sheet feeding cassette 22 containing the sheets and mounted to a lower portion of the main body 10 of the apparatus for drawing movement. The sheet feeding cassette 22 is provided with a cassette tray 23 as first sheet containing portion for stacking and containing sheets S, separating means (not shown such as a separation claw or a separation pad for separating the sheets one by one, and one roller 24*a* of a pair of conveying rollers, and the cassette tray 23, separating means and roller 24*a* constitute the sheet feeding cassette supplying means 20. Further, at an end of a drawing side of the sheet feeding cassette 22, there is provided the multi supplying means 21 having a multi tray 25 as a second sheet containing portion independently from the cassette tray 23.

Further, the main body 10 of the apparatus includes a pick-up roller 26 as first sheet feeding means for feeding out the sheet(s) stacked and contained on the cassette tray 23, and the other roller 24*b* of the pair of conveying rollers, and the pick-up roller 26 is driven by a driving portion which will be described later. The sheets S contained in the cassette tray 23 are picked up by the pick-up roller 26 and then are separated one by one by means of the separating means. The separated sheet is conveyed by the pair of conveying rollers 24*a*, 24*b* to be fed to the image forming means 12.

On the other hand, the multi supplying means 21 integral with the cassette tray 23 includes a multi tray 25 on which a sheet stack or bundle is manually set by the operator, a pick-up roller 27 as second sheet feeding means for feeding out the sheets stacked on the multi tray 25, a separation pad 28 for separating the sheets S fed out by the pick-up roller 27 one by one, and a pair of conveying rollers 29 for conveying the separated sheet. Incidentally, the multi tray 25 is provided with side guides (not shown) for regulating lateral edges of the sheets S.

As shown in FIG. 3, the multi supplying means 21 includes a lifting/lowering plate 31 for supporting leading end portions of the sheets stacked on the multi tray 25 and for urging the sheets against the pick-up roller 27. A cam 32 for controlling lifting/lowering of the lifting/lowering plate 31 is attached to a rotary shaft 30 of the pick-up roller 27. With this arrangement, when the pick-up roller 27 is rotated by rotation of the rotary shaft 30, the lifting/lowering plate 31 is lifted by the action of the cam 32 attached to the rotary shaft 30 and by the action of a synchronous plate 33 for transmitting the motion of the cam 32 to the lifting/lowering plate 31, with the result that the leading end portions of the sheet stack S is urged against the pick-up roller 27.

The sheets S are separated one by one by cooperation between the pick-up roller 27 and the separation pad 28, and the separated sheet is conveyed by the pair of conveying rollers 29 to be supplied to the image forming means 12.

Incidentally, as mentioned above, the sheet feeding cassette 22 is detachably mountable to the main body 10 of the apparatus. When the sheets S are contained in the cassette tray 23, the sheet feeding cassette 22 is drawn from the main body 10 of the apparatus in a direction shown by the arrow in FIG. 2, and, after the sheets S are contained, the sheet feeding cassette 22 is pushed or retracted into the main body 10 of the apparatus.

By the way, the pick-up roller 27 and the conveying roller pair 29 of the multi supplying means 21 are driven by driving means provided in the main body 10 of the apparatus. By providing the driving means for driving the multi supplying means 21 within the main body 10 of the apparatus in this way, in other words, by not providing the driving means on the multi supplying means 21, the multi supplying means 21 can be made more compact, thereby making the printer itself more compact.

Next, a construction of drive transmitting means for causing a driving source provided in the main body 10 of the apparatus to drive the sheet supplying means 8 will be explained with reference to FIGS. 4 to 8. Incidentally, in the illustrated embodiment, the drive transmitting means is designed to also drive the pick-up roller 26 of the cassette supplying means 20 and the conveying roller 24*a* provided on the sheet feeding cassette 22.

Figure 4:
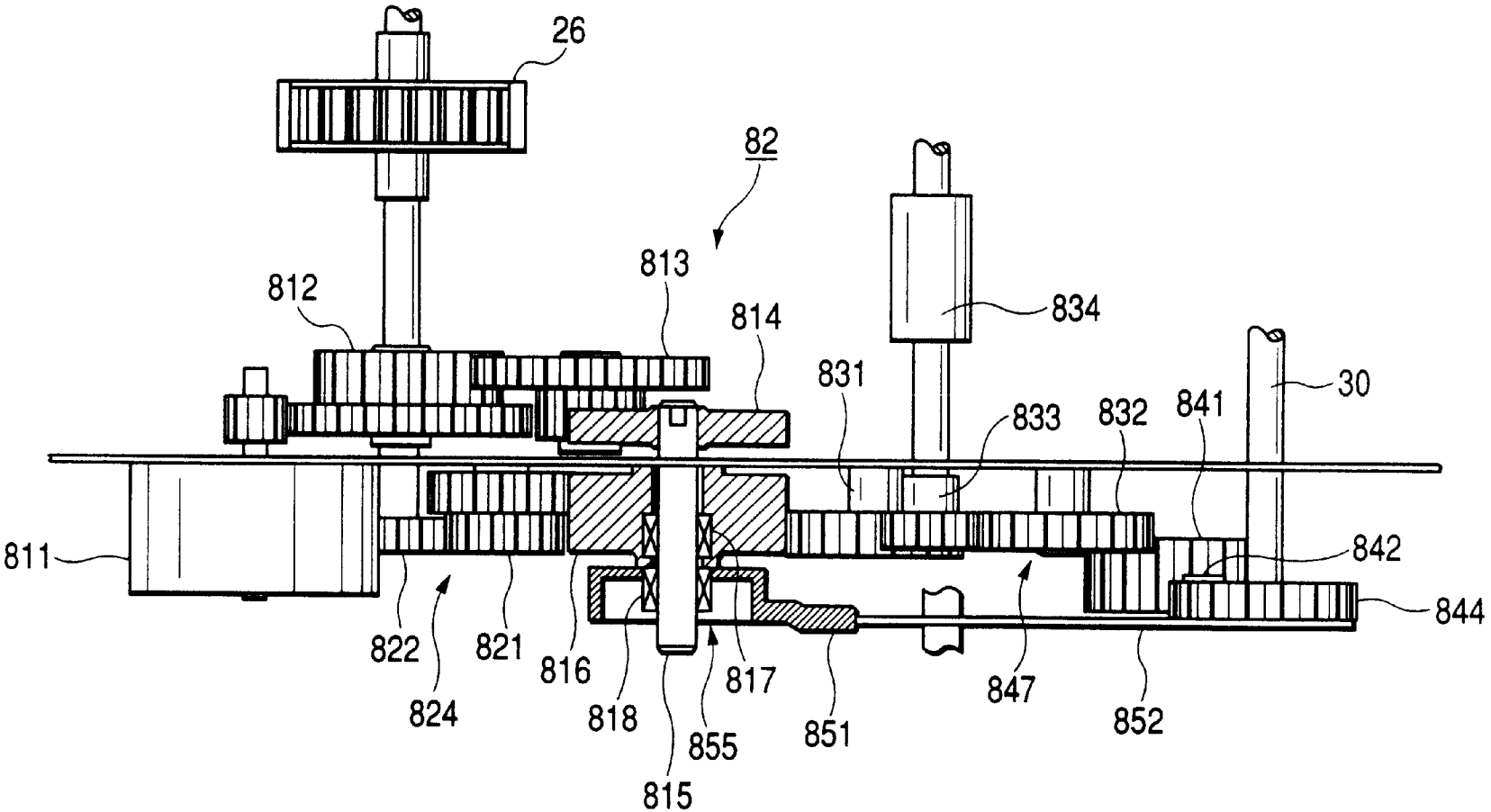
FIG. 4 is a plan view of a gear train from a driving source to various rollers.
Figure 5:
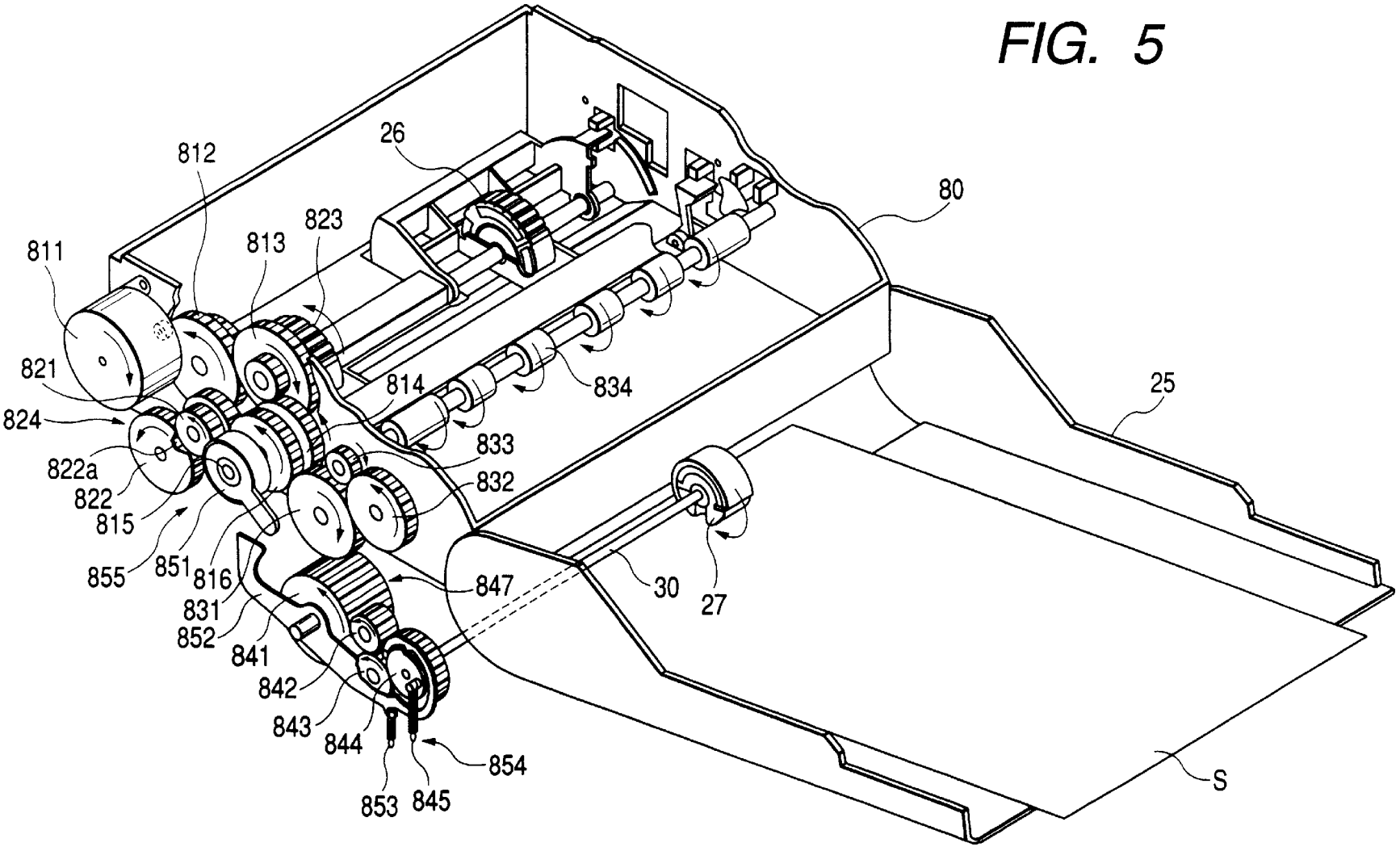
FIG. 5 is a perspective view showing a condition that a driving force is transmitted from the driving source.

As shown in FIGS. 4 and 5, a sheet supplying diving gear train 82 of the sheet supplying means 8 serves to selectively transmit a driving force from a stepping motor 811 of the driving source to the pick-up roller 26 for supplying the sheet from the cassette tray 23, a registration roller 834, a driving rotary lever 851 for operating a multi sheet supplying driving arm 852, and the pick-up roller 27 for supplying the sheet from the multi tray 25.

The sheet supplying driving gear train 82 is constituted by a sheet feeding cassette pick-up roller rotational force transmitting portion (first rotational force transmitting means) 824 for transmitting the driving force to the pick-up roller 26 of the cassette supplying means 20, and a multi pick-up roller rotational force transmitting portion (second rotational force transmitting means) 847.

The multi pick-up roller rotational force transmitting portion (second rotational force transmitting means) 847 is constituted by a gear train including a starting gear 812, idle gears 813, 814, a driving shaft 815, a one-way bearing 817, a driving gear 816, idle gears 831, 841, 842, 843 and a multi sheet non-toothed gear (second non-toothed gear) 844.

Further, the sheet feeding cassette pick-up roller rotational force transmitting portion (first rotational force transmitting means) 824 is constituted by a gear train including the starting gear 812, the idle gears 813, 814, the driving shaft 815, the one-way bearing (one-way clutch) 817, the driving gear 816, an idle gear 821 and a sheet feeding cassette sheet supplying non-toothed gear (first non-toothed gear) 822.

Figure 7:
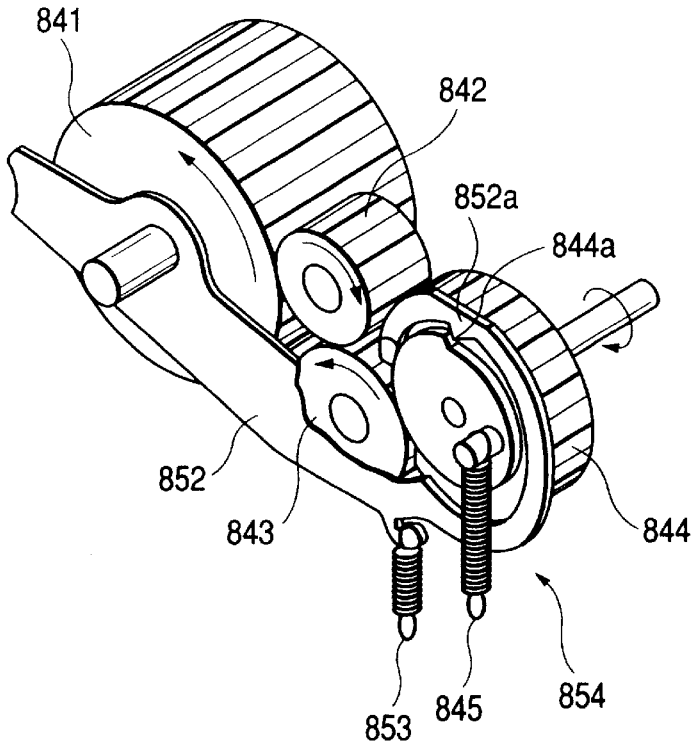
FIG. 7 is an enlarged perspective view of a rotational force interrupting portion.

Next, a mechanism for controlling driving transmission of the pick-up roller 27 of the multi supplying means 21 will be explained with reference to FIG. 7.

A multi sheet supplying driving arm (engaging/disengaging arm) 852 is rockably supported on a shaft of the idle gear 841 and is provided at its end with an engaging portion 852*a* engaged by an engaged portion 844*a* provided on the multi sheet supplying non-toothed gear 844 thereby to regulate rotation of the multi sheet supplying non-toothed gear 844. Normally, the multi sheet supplying driving arm 852 is rotatingly biased by a multi sheet supplying driving arm spring 853 toward a direction along which the engaging portion 852*a* is engaged by the engaged portion 844*a*. In a condition that the multi sheet supplying non-toothed gear 844 is regulated, since a non-toothed portion of the multi sheet supplying non-toothed gear 844 is opposed to the idle gear 843, the driving force is not transmitted. A multi sheet supplying non-toothed gear spring (rotation biasing means) 845 serves to rotate the multi sheet supplying non-toothe gear 844 to be engaged by the idle gear 843 when the regulation of the multi sheet supplying non-toothed gear 844 is released. Incidentally, the multi sheet supplying driving arm (engaging/disengaging arm) 852, multi sheet supplying non-toothe gear 844, multi sheet supplying non-toothed gear spring (rotation biasing means) 845, multi sheet supplying driving arm spring 853, engaged portion 844*a* and engaging portion 852*a* constitute a rotational force interrupting (blocking) portion (rotational force interrupting means).

The driving gear 816 and the driving rotary lever (operating lever) 851 are provided on the driving shaft 815 for opposite rotational movements by means of one-way bearings (one-way clutches) 817, 818. Incidentally, the one-way bearing (one-way clutch) 818 and the driving rotary lever (operating lever) 851 constitute an operation switching portion (operation switching means) 855.

Next, the operation of the drive transmission will be described.

Normally, as shown in FIG. 5, when the stepping motor 811 is rotated in a direction shown by the arrow in FIG. 5, a rotational force of the motor 811 is transmitted to the driving gear 816 through the starting gear 812, idle gear 813, 814, driving shaft 815 and one-way bearing (one-way clutch) 817, thereby rotating the driving gear 816 in a direction shown by the arrow in FIG. 5. However, the driving rotary lever 851 is not rotated and remains stationary due to the presence of the one-way bearing (one-way clutch) 818.

By the driving gear 816, the sheet feeding cassette sheet supplying non-toothed gear 822 to which the shaft of the pick-up roller 26 is secured is rotated via the idle gear 821, thereby rotating the pick-up roller 26. At the same time, by the driving gear 816, a registration roller gear 833 is rotated via the idle gear 831, 832, thereby rotating the registration roller 834.

Since a non-toothed portion 822*a* is formed on the sheet feeding cassette sheet supplying non-toothed gear 822, when the sheet feeding cassette sheet supplying non-toothed gear 822 is rotated by about one revolution, the pick-up roller 26 is stopped. Incidentally, the sheet feeding cassette sheet supplying non-toothed gear 822 is normally held by a solenoid (not shown) so that the non-toothed portion 822*a* is opposed to the idle gear 821. When it is desired to rotate the pick-up roller 26, the holding is released, thereby engaging the sheet feeding cassette sheet supplying non-toothed gear 822 by the idle gear 821.

Figure 6:
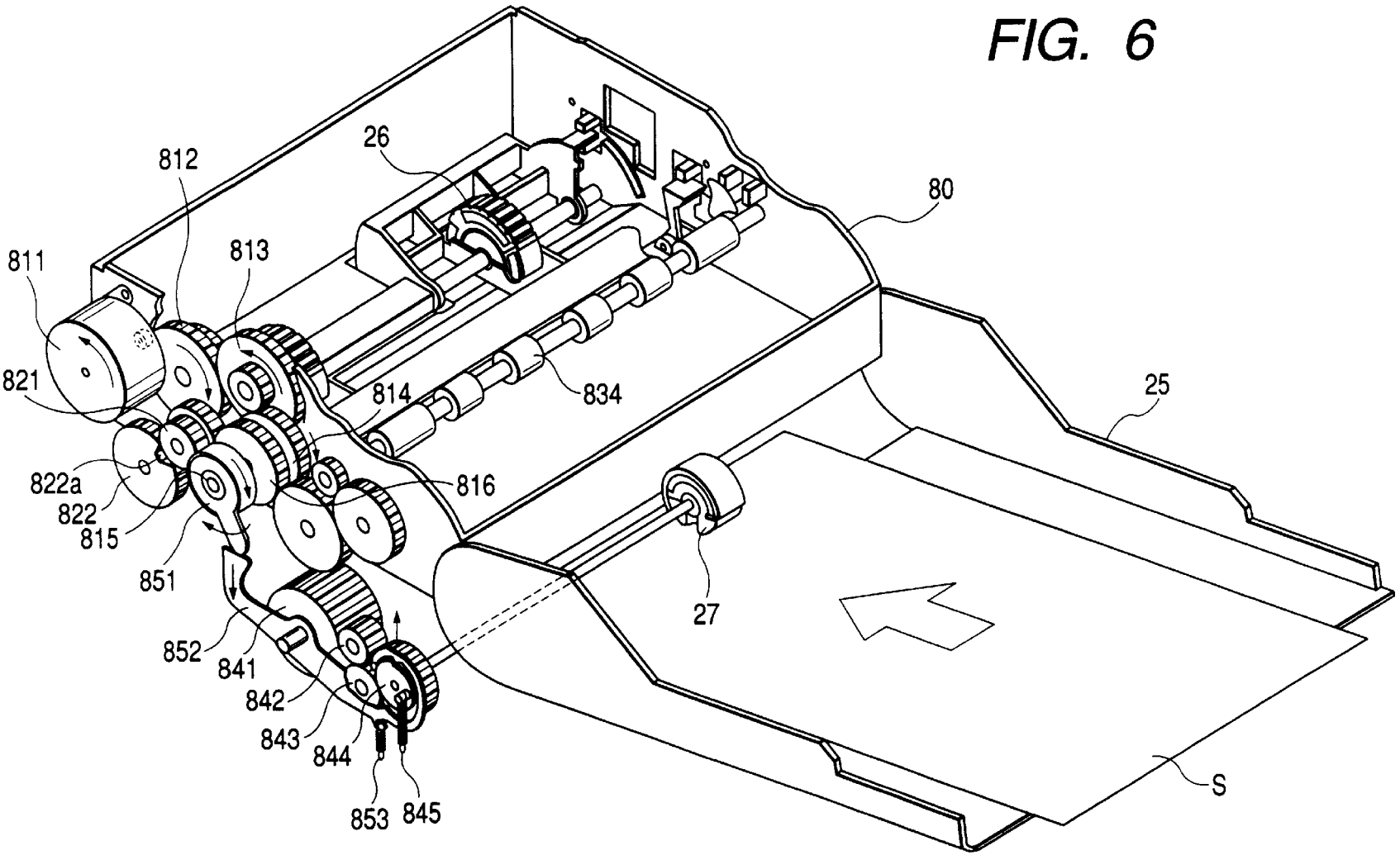
FIG. 6 is a perspective view showing a condition that the driving force from the driving source is transmitted to a multi sheet supplying diving arm.

On the other hand, as shown in FIG. 6, when the stepping motor 811 is rotated in a direction shown by the arrow in FIG. 6, the driving shaft 815 is rotated reversely. In this case, since the rotation is not transmitted to the driving gear 816 by the action of the one-way clutch 817, the driving gear 816 is stopped. Thus, when the stepping motor 811 is rotated in the direction shown by the arrow in FIG. 6, the pick-up roller 26 is not rotated. However, the driving rotary lever 851 receives the rotational force of the driving shaft 815 through the one-way bearing 818 and is rotated in a direction shown by the arrow in FIG. 6.

When the driving rotary lever 851 is rotated in the direction shown by the arrow in FIG. 6, the multi sheet supplying driving arm 852 is rotated in a direction shown by the arrow in FIG. 6 in opposition to the multi sheet supplying driving arm spring 853, with the result that the regulation of rotation of the multi sheet supplying non-toothed gear 844 caused by the multi sheet supplying driving arm 852 is released. As a result, the multi sheet supplying non-toothed gear 844 is rotated by the multi sheet supplying non-toothed gear spring 845, with the result that a non-toothed portion (not shown) is not opposed to and is engaged by the idle gear 843. Consequently, a driving rotation transmitting path is connected between the multi sheet supplying non-toothed gear 844 and the stepping motor 811.

Again, when the stepping motor 811 is rotated in the direction shown by the arrow in FIG. 5, the rotational force of the stepping motor 811 is transmitted to the multi sheet supplying non-toothed gear 844 through the starting gear 812, idle gears 813, 814, driving shaft 815, one-way bearing 817, driving gear 816 and idle gears 831, 841, 842, 843, with the result that the pick-up roller 27 is rotated in a direction shown by the arrow in FIG. 5 together with the multi sheet supplying non-toothed gear 844, thereby supplying the sheet S on the multi tray 25.

Incidentally, the gear train 854 comprised of the idle gears 841, 842, 843 and the multi sheet supplying non-toothed gear 844 is provided on the sheet feeding cassette 22, so that, when the sheet feeding cassette 22 is mounted to the main body 10 of the apparatus, the idle gear 841 is engaged by the idle gear 831 of the main body 10 of the apparatus, thereby permitting the transmission of the driving force.

Further, when the stepping motor 811 is rotated in the direction shown by the arrow in FIG. 5, the registration roller 834 is also rotated. However, since the non-toothed portion 822*a* of the sheet feeding cassette sheet supplying non-toothed gear (first non-toothed gear) 822 is opposed to the idle gear 821 and is engaged by a lever (not shown) and is held by a solenoid (engaging/disengaging means), the pick-up roller 26 of the sheet feeding cassette supplying means 20 is not rotated. That is to say, the sheet feeding cassette sheet supplying non-toothed gear 822 and the solenoid (not shown) constitute simultaneous rotation preventing means for preventing of simultaneous rotations of the pick-up roller 26 of the sheet feeding cassette supplying means 20 and of the pick-up roller 27 of the multi supplying means 21 which will be described later.

Figure 8:
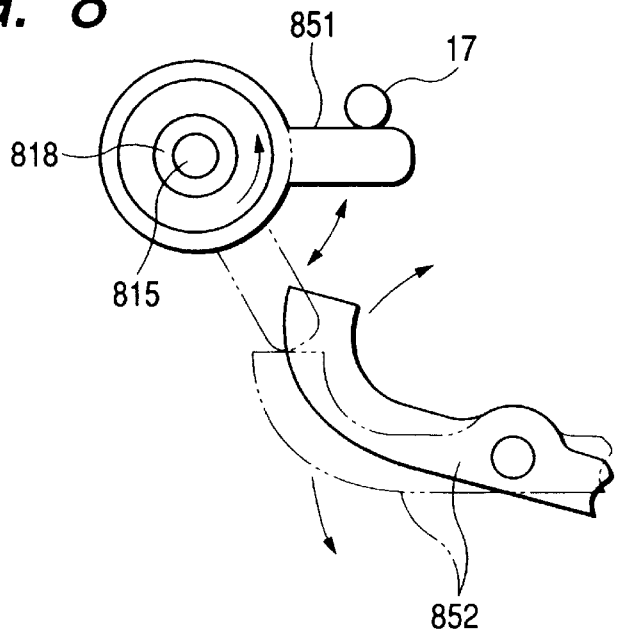
FIG. 8 is a view for explaining operation of a driving rotary lever and the multi sheet supplying driving arm.

On the other hand, again, when the stepping motor 811 is rotated in the direction shown by the arrow in FIG. 5, as shown in FIG. 8, the driving shaft 815 is rotated in an anti-clockwise direction, and the driving rotary lever 851 is also rotatingly driven through the one-way bearing (by more or less friction in the one-way bearing 818). As a result, the multi sheet supplying driving arm 852 is biased by the multi sheet supplying driving arm spring 853 to be returned from a broken line position to a solid line position in FIG. 8. However, the driving rotary lever 851 abuts against a fixed stopper pin 17 and is stopped. The driving shaft 815 is rotated in an anti-clockwise direction by the action of the one-way bearing 818. The multi sheet supplying driving arm 852 is rotated from the broken line position to the solid line position, thereby permitting the regulation of rotation of the multi sheet supplying non-toothed gear 844. As a result, when the multi sheet supplying non-toothed gear 844 is rotated by about one revolution together with the pick-up roller 27, the engaging portion 852*a* of the multi sheet supplying driving arm 852 is engaged by the engaged portion 844a of the multi sheet supplying non-toothed gear 844, thereby stopping the rotation of the pick-up roller 27. In this case, the non-toothed portion (not shown) of the multi sheet supplying non-toothed gear 844 is opposed to the idle gear 843, thereby interrupting the transmission of the rotational force of the stepping motor 811. Further, in this case, the multi sheet supplying non-toothed gear spring 845 is in a pulled condition. Thus, the initial condition is restored for preparing a next sheet feeding operation.

Figure 9:
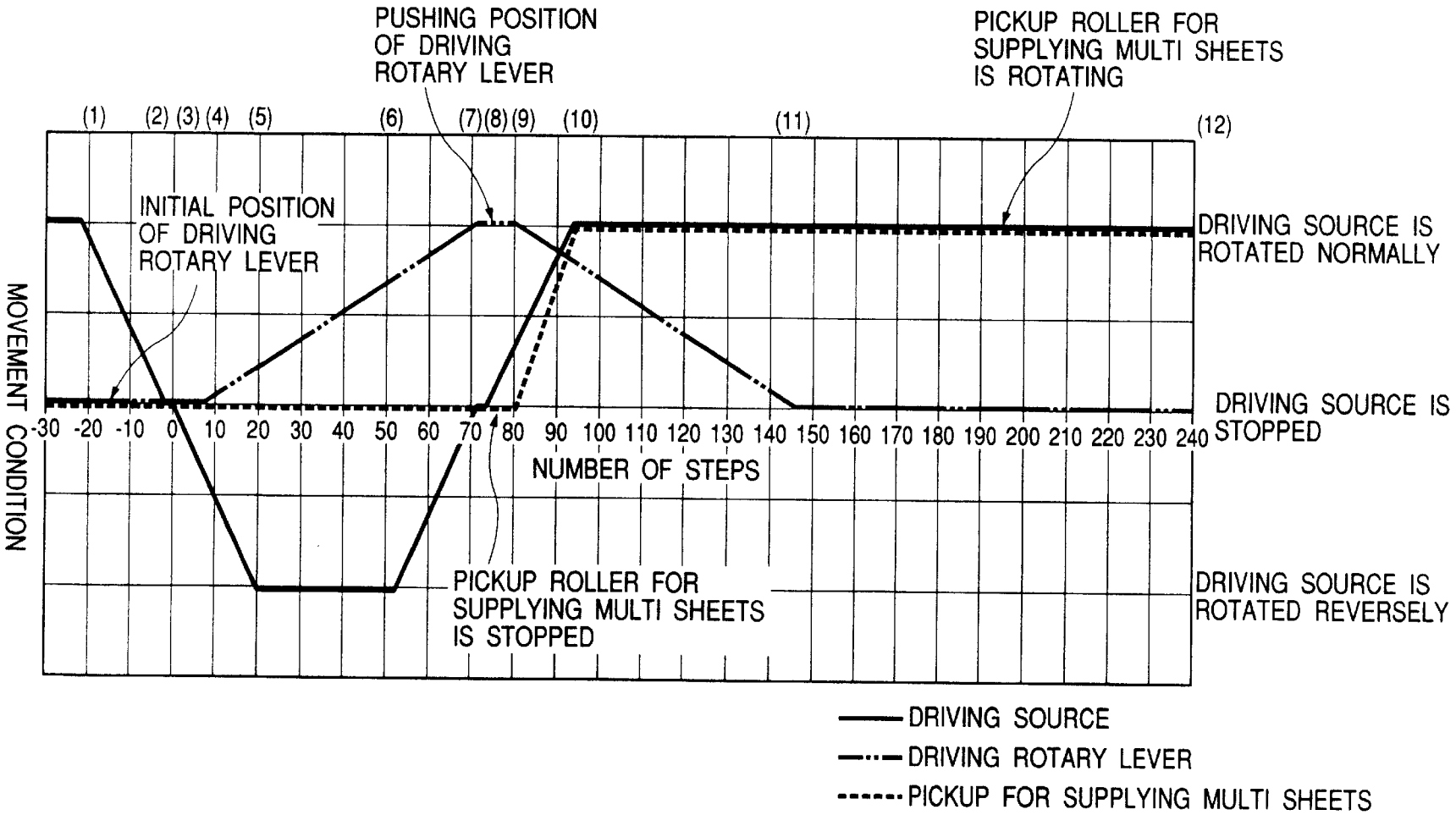
FIG. 9 is a graph showing a sequence when the sheets are supplied from the multi supplying means.

FIGS. 9 and 10 is graph and table for showing a multi sheet supplying operation sequence for effecting the multi sheet supplying by temporarily rotating the stepping motor 811 reversely. In FIGS. 9 and 10, when the stepping motor 811 is changed from normal rotation (1) in the direction shown by the arrow in FIG. 5 to the stopping (2) and then to reverse rotation (3) in the direction shown by the arrow in FIG. 6, the driving rotary lever 851 starts to be rotated toward a pushing position of the multi sheet supplying driving arm 852 shown by the phantom line in FIG. 8 (4). When the stepping motor 811 is changed from the reverse rotation (3) to the stopping (7), the driving rotary lever 851 reaches the pushing position of the multi sheet supplying driving arm 852 shown by the phantom line in FIG. 8 (7). Thereafter, when the stepping motor 811 effects the normal rotation (8) (9), the driving rotary lever 851 starts to be rotated toward the initial position shown by the solid line (9) (10). As a result, the pick-up roller 27 starts to be rotated (9). During the normal rotation (12) of the stepping motor 811, the driving rotary lever 851 is stopped at the initial position shown by the solid line (11) (12). Thereafter, the rotation of the pick-up roller 27 is stopped (12).

In this way, since the sheet supplying means according to the illustrated embodiment does not utilize the solenoid for operating the multi sheet supplying starting arm 852 when the sheet S is supplied from the multi tray 25 to the image forming means 12, the solenoid, and a substrate, a cable and a connector required for the solenoid can be omitted, thereby simplifying the structure and reducing the cost.

Figure 11:
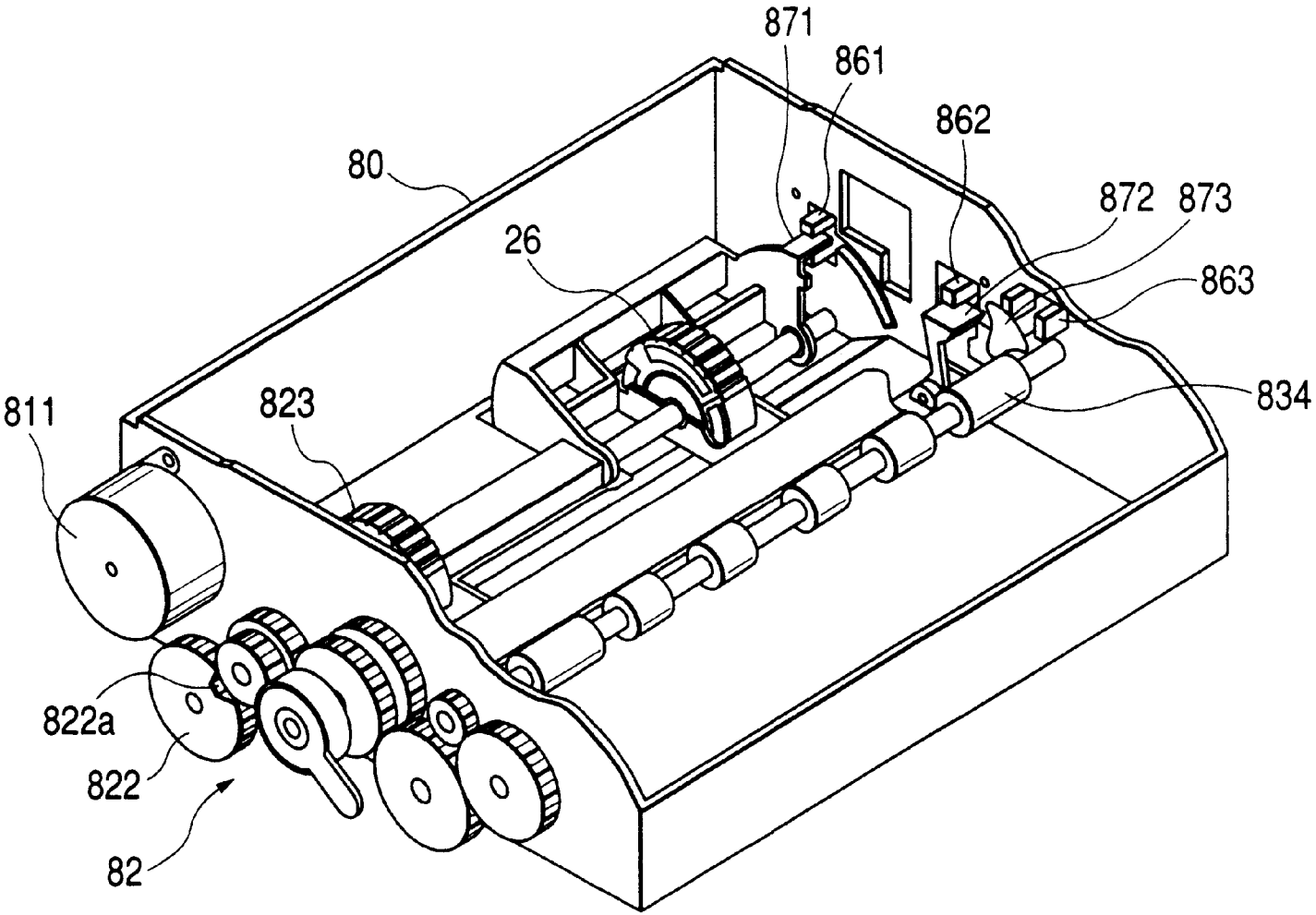
FIG. 11 is a perspective view showing a condition that a sensor substrate is installed.

Next, a construction in which the sheet supplying means 8 is designed as a unit will be explained with reference to FIGS. 11 to 13. The sheet supplying means 8 is constituted as a unit together with a mechanism (such as a sheet supplying driving gear train 82 for starting the supplying of the sheet from the multi tray 25 effected by the reverse rotation of the stepping motor 811, and the driving rotary lever 851), and mechanical and electrical parts required for the sheet feeding operation.

Figure 12:
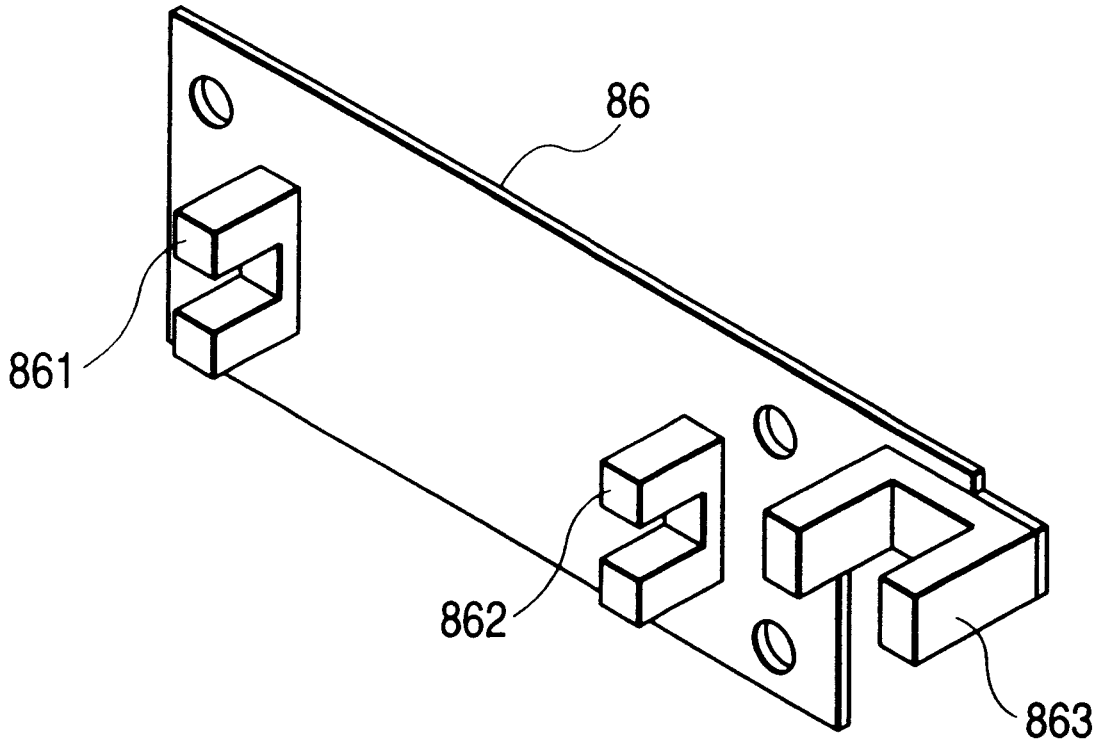
FIG. 12 is a perspective view of the sensor substrate having detecting sensors.
Figure 13:
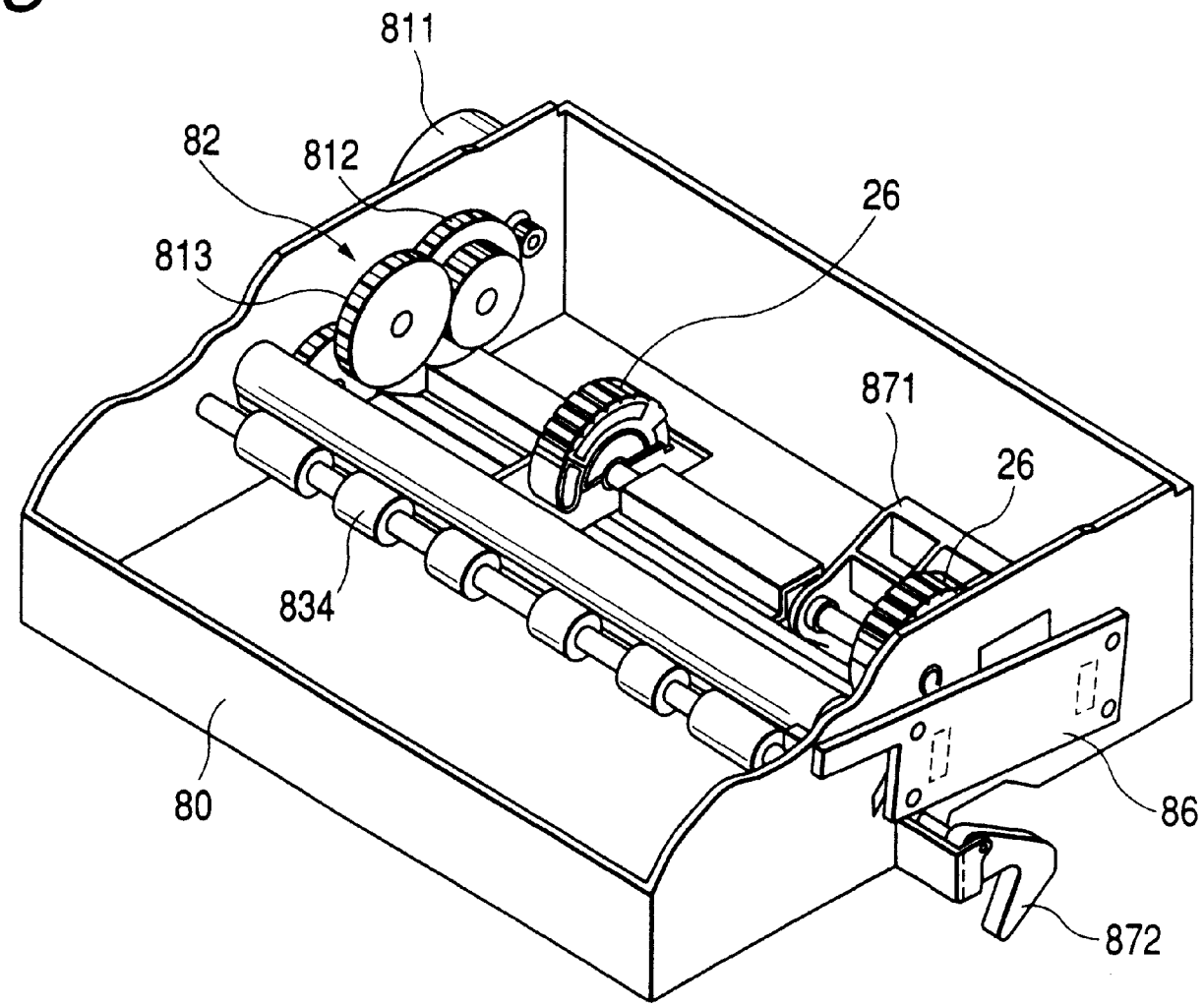
FIG. 13 is a perspective view showing a condition that a sensor substrate and the like are installed.

In FIG. 12, a common sheet supplying sensor substrate (substrate) 86 is provided with a sheet feeding cassette supplying sheet presence/absence detecting sensor (first sheet detecting means) 861 for detecting whether the sheet S exists in the sheet feeding cassette supplying means 20 or not, a multi supplying sheet presence/absence detecting sensor (second sheet detecting means) 862 for detecting whether the sheet S exists on the multi tray 25 or not, and a sheet leading end detecting sensor 863 for detecting a leading end of the sheet S in the vicinity of the registration roller 834. Incidentally, photo-sensors of permeable type are used as these sensors.

The sheet supplying means 8 is reinforced by a sheet supplying casing 80. In FIG. 13, the sheet supplying sensor substrate 86 is attached to a right end of the sheet supplying casing 80. In FIG. 11, the detecting sensors 861, 862, 863 are protruded into the sheet supplying casing 80. A sheet feeding cassette supplying sheet presence/absence detecting sensor lever 871 is rotatably disposed in the vicinity of the sheet feeding cassette supplying sheet presence/absence detecting sensor 861 to perform its detecting function, a multi supplying sheet presence/absence detecting sensor lever 872 is rotatably disposed in the vicinity of the multi supplying sheet presence/absence detecting sensor 862 to perform its detecting function, and a sheet leading end detecting sensor lever 873 is rotatably disposed in the vicinity of the sheet leading end detecting sensor 863 to perform its detecting function. By arranging the detecting sensors 861, 862, 863 on the single sheet supplying sensor substrate 86 collectively in this way, relay cables for connecting between the detecting sensors 861, 862, 863 and the sheet supplying sensor substrate 86 can be omitted, thereby enhancing the reliability and reducing the cost.

Further, the pick-up roller 26, the registration roller 834 and a U-turn roller 835 which serve to separate and convey the sheets S on the cassette tray 23 and the multi tray 25, the sheet supplying driving gear train 82 for transmitting the driving force to these rollers, and the stepping motor 811 are attached to the sheet supplying means 8. Thus, the sheet supplying means 80 according to the illustrated embodiment is characterized in that it integrally includes a sheet supplying starting mechanism for starting the supplying of the sheet from the multi tray 25 effected by the reverse rotation of the stepping motor 811, and mechanical and electrical parts required for the supplying. With this arrangement, the detachable mounting to the main body 10 of the color printer can be facilitated, and assembling ability and maintenance of the color printer 9 can be enhanced.

By the way, as mentioned above, by driving the pick-up roller 27 and the conveying roller pair 29 of the multi supplying means 21 by means of the driving portion provided in the main body 10 of the apparatus and by eliminating electrical connection between the main body 10 and the sheet feeding cassette 22 by effecting the electrical connection of the solenoid used for the rotation control within the main body of the apparatus, even when the multi supplying means is provided, the construction of the sheet feeding cassette 22 can be simplified, and the number of parts can be reduced.

Further, when the driving means is not provided in the multi supplying means 21, as mentioned above, the multi supplying means 21 and the sheet feeding cassette 22 having such multi supplying means can be made compact, thereby making the entire printer compact.

Figure 14:
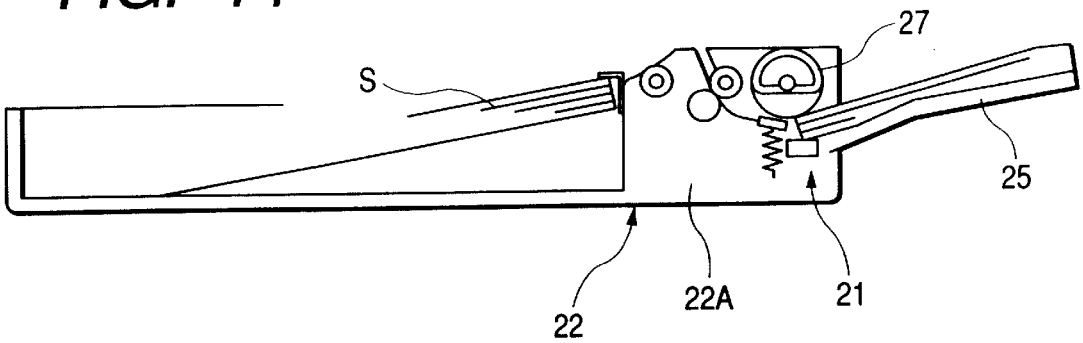
FIG. 14 is a view for explaining a construction of the sheet feeding cassette.

On the other hand, in the illustrated embodiment, as shown in FIG. 14, a frame 22A of the sheet feeding cassette 22 has a mono-cock structure molded from single molding material so that the sheet feeding cassette 22 and the multi supplying means 21 are formed integrally. By integrally forming the sheet feeding cassette 22 and the multi supplying means 21 in this way, the number of parts can be reduced, and the cost can be reduced.

Figure 15:
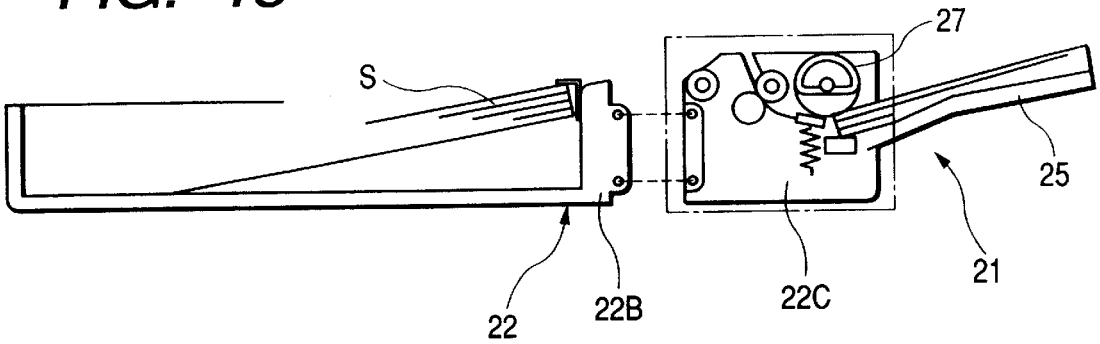
FIG. 15 is a view for explaining another construction of the sheet feeding cassette.

Incidentally, the construction of the sheet feeding cassette 22 is not limited to that shown in FIG. 14, but, for example, as shown in FIG. 15, a frame may be divided into a frame 22B for the sheet feeding cassette 22, and a frame 22C on which the multi supplying means is mounted, and these frames 22B, 22C may integrally secured to each other by fastening means such as screws.

By dividing the frame into the frames 22B, 22C in this way, i.e., by detachably attaching the multi supplying means 21 to the sheet feeding cassette 22, the sheet feeding cassette 22 can also be used as a sheet feeding cassette only requiring optional sheet feeding cassette sheet containing portion (cassette tray 23), the number of parts can be reduced, and the space assumed by the unnecessary functions can be reduced.

Figure 16:
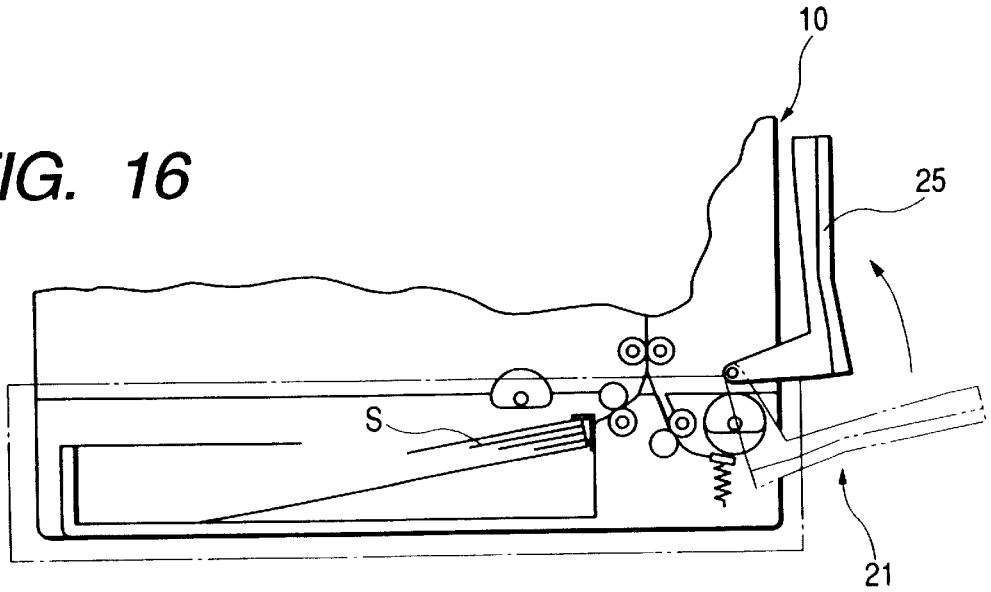
FIG. 16 is a view for explaining other construction of the sheet feeding cassette.

Further, as shown in FIG. 16, the sheet feeding cassette 22 may be designed so that the multi tray 25 of the multi supplying means 21 is rotatably (shiftably) provided in the main body 10 of the apparatus and, only when the multi supplying means is used, the multi tray 25 is rotated downwardly.

With this arrangement, when the multi supplying means 21 is not used, the multi tray 25 can be contained within the main body of the apparatus, thereby saving the space. Further, when the multi-tray 25 is not provided on the sheet feeding cassette 22, the latter can be lightened.

What is claimed is:

1. An image forming apparatus for forming an image on a sheet, comprising:

a sheet feeding cassette containing a sheet and mounted drawably to a main body of said apparatus;

first sheet feeding means for feeding out the sheet from a first sheet containing portion provided in said sheet feeding cassette; and image forming means for forming an image on the sheet fed out by said first sheet feeding means;

wherein said sheet feeding cassette is provided with second sheet feeding means for feeding out a sheet contained in a second sheet containing portion different from said first sheet containing portion of said sheet feeding cassette.

2. An image forming apparatus according to claim 1, wherein said second sheet containing portion is provided on said sheet feeding cassette.

3. An image forming apparatus according to claim 1, wherein said first sheet feeding means includes a pick-up roller for feeding out the sheet from said sheet feeding cassette, and said pick-up roller is provided in said main body of said apparatus.

4. An image forming apparatus according to claim 1, further comprising first sheet detecting means for detecting whether the sheet is stacked in said sheet feeding cassette, and second sheet detecting means for detecting whether the sheet is stacked in said second sheet containing portion, wherein said first and second sheet detecting means are provided on a common substrate.

5. An image forming apparatus according to claim 1, wherein said second sheet feeding means is integrally provided on said sheet feeding cassette.

6. An image forming apparatus according to claim 1, wherein said second sheet feeding means is detachably provided on said sheet feeding cassette.

7. An image forming apparatus according to claim 1, wherein said second sheet containing portion is provided on said main body of said apparatus.

8. An image forming apparatus according to claim 7, wherein said second sheet containing portion has a tray for supporting the sheet, and said tray is provided in said main body of said apparatus rockably between a position where said tray contains the sheet and a position where said tray does not contain the sheet.

9. An image forming apparatus according to claim 1, further comprising drive transmitting means for driving said first sheet feeding means and said second sheet feeding means by using a driving source provided in said main body of said apparatus.

10. An image forming apparatus according to claim 9, wherein said second sheet feeding means includes a pick-up roller for feeding out the sheet, and a lifting/lowering plate shiftable between a position where the sheet is urged against said pick-up roller and a position where the urging is released, and rotation of said pick-up roller and a lifting/lowering movement of said lifting/lowering plate are effected by driving of said driving source.

11. An image forming apparatus according to claim 9, wherein said drive transmitting means includes a gear train in said main body of said apparatus, and a gear train provided in said sheet feeding cassette for transmitting the driving to said second sheet feeding means, so that, when said sheet feeding cassette is mounted to said main body of said apparatus, said gear trains are interconnected, thereby permitting transmission of the driving to said second sheet feeding means.

12. An image forming apparatus according to claim 9, wherein said drive transmitting means includes a first gear train capable of transmitting a rotational force of said driving source to said first sheet feeding means when said driving source is rotated normally, and further comprising a first driving side gear by which the rotational force of said driving source is transmitted to said first gear train, a first non-toothed gear provided engageable with said first driving side gear, and engaging/disengaging means releasably engaged with said first non-toothed gear and adapted to prevent rotation of said first non-toothed gear in a condition that a non-toothed portion of said first non-toothed gear is opposed to said first driving side gear.

13. An image forming apparatus according to claim 9, wherein said drive transmitting means includes second rotational force transmitting means for transmitting a rotational force of said driving source to said second sheet feeding means when said driving source is rotated normally, rotational force interrupting means for interrupting a rotational force transmitting condition of said second rotational force transmitting means when said second sheet feeding means is rotated by a predetermined amount by means of said second rotational force transmitting means, and operation switching means for releasing an operation of said rotational force interrupting means to bring said second rotational force transmitting means to the rotational force transmitting condition when said driving source is rotated reversely.

14. An image forming apparatus according to claim 13, further comprising first rotational force transmitting means for transmitting the rotational force of said driving source to said first sheet feeding means when said driving source is rotated normally, and simultaneous rotation preventing means for interrupting transmission of the rotational force to said first sheet feeding means by said first rotational force transmitting means when said second sheet feeding means is rotated by said second rotational force transmitting means.

15. An image forming apparatus according to claim 13, wherein said second rotational force transmitting means has a second gear train, and further comprising a second driving side gear by which the rotational force from said driving source is transmitted to said second gear train, and a second non-toothed gear engageable with said second driving gear, and wherein said rotational force interrupting means includes an engaging/disengaging arm detachably engaged with said second non-toothed gear and adapted to prevent rotation of said second non-toothed gear in a condition that a non-toothed portion of said second non-toothed gear is opposed to said second driving side gear, and rotation biasing means for biasing rotation of said second non-toothed gear to engage said second non-toothed gear with said second driving side gear when engagement between said second non-toothed gear and said engaging/disengaging arm is released, and said operation switching means includes an operating lever rotated by the rotational force of said driving source when said driving source is rotated reversely, thereby acting on said engaging/disengaging arm to release the engagement between said second non-toothed gear and said engaging/disengaging arm.

16. An image forming apparatus according to claim 15, wherein said second gear train is provided with a one-way clutch for transmitting the rotation of said driving source to said second driving side gear when said driving source is rotated normally.

17. An image forming apparatus according to claim 15, wherein said operating lever is connected to one of gears in said second gear train through a one-way clutch, and the rotation when said driving source is rotated reversely is transmitted to said operating lever through said one-way clutch, thereby releasing the engagement between said second non-toothed gear and said engaging/disengaging arm.

* * * * *

UNITED STATES PATENT AND TRADEMARK OFFICE

CERTIFICATE OF CORRECTION

PATENT NO. : 6,543,758 B2
DATED : April 8, 2003
INVENTOR(S) : Tomoaki Imura et al.

It is certified that error appears in the above-identified patent and that said Letters Patent is hereby corrected as shown below:

Column 1,
Line 39, “feeding-the” should read -- feeding the --.

Column 2,
Line 32, “other” should read -- another --.
Line 45, “and” should read -- and a --.

Column 3,
Line 16, “an” should read -- a --.

Column 4,
Line 43, “diving” should read -- driving --.

Column 5,
Line 17, “In” should read -- On --.
Lines 23 and 28, “non-toothe” should read -- non-toothed --.
Line 57, “gear” should read -- gears --.

Column 7,
Line 23, “is” should read -- is a --.

Column 8,
Line 39, “for the” should read -- for --.

Signed and Sealed this

Seventh Day of October, 2003

JAMES E. ROGAN
*Director of the United States Patent and Trademark Office*